US009833832B2

(12) United States Patent
Weyland et al.

(10) Patent No.: US 9,833,832 B2
(45) Date of Patent: Dec. 5, 2017

(54) RIVETING TOOL

(71) Applicant: TKR Spezialwerkzeuge GmbH, Gevelsberg (DE)

(72) Inventors: Thorsten Weyland, Herdecke (DE); Karl Buchholz, Schwerte (DE)

(73) Assignee: TKR Spezialwerkzeuge GmbH, Gevelsberg (DE)

( * ) Notice: Subject to any disclaimer, the term of this patent is extended or adjusted under 35 U.S.C. 154(b) by 0 days.

(21) Appl. No.: 15/351,375

(22) Filed: Nov. 14, 2016

(65) Prior Publication Data

US 2017/0136523 A1 May 18, 2017

(30) Foreign Application Priority Data

Nov. 12, 2015 (DE) ..... 10 2015 119 571

(51) Int. Cl.
*B21J 15/00* (2006.01)
*B21J 15/04* (2006.01)
(Continued)

(52) U.S. Cl.
CPC ..... *B21J 15/043* (2013.01); *B21J 15/046* (2013.01); *B21J 15/105* (2013.01); *B21J 15/20* (2013.01);
(Continued)

(58) Field of Classification Search
CPC ... B25B 27/0014; B21J 15/043; B21J 15/046; B21J 15/32; B21J 15/105; B21J 15/20; B25D 9/12
(Continued)

(56) References Cited

U.S. PATENT DOCUMENTS 4,425,782 A * 1/1984 Todisco ..... B21J 15/043 72/114
6,449,822 B1 9/2002 Gilbert et al.
(Continued)

FOREIGN PATENT DOCUMENTS

DE 299 14 202 U1 1/2001
DE 10 2010 024 610 A1 12/2011
EP 2 786 843 A2 10/2014

OTHER PUBLICATIONS

Extended European Search Report dated Mar. 13, 2017 in Application No. 16195039.9 (7 pages) (German Only).

*Primary Examiner* — David B Jones
(74) *Attorney, Agent, or Firm* — Flaster/Greenberg P.C.

(57) ABSTRACT

The invention relates to a riveting tool for setting blind rivet nuts and/or blind rivet screws, comprising a drive piston which is able to be hydraulically adjusted from an initial position toward an end position, a pull rod which is releasably and operatively connected to the drive piston and which is able to be adjusted by the drive piston from a rivet receiving position into a setting position and a coupling element fixing the pull rod and a drawing mandrel to one another in the longitudinal axial direction. In order to provide a riveting tool of the type mentioned above by which uniform setting processes of rivets may be carried out with a high degree of repeated accuracy, it is provided that the riveting tool for fixing the setting position has an adjusting unit with a stroke-limiting element which is axially adjustable relative to the coupling element in the longitudinal axial direction of the pull rod, said stroke-limiting element being in engagement with the coupling element via a stop surface in the setting position.

19 Claims, 10 Drawing Sheets

(51) Int. Cl.

| | |
|---|---|
| ***B21J 15/38*** | (2006.01) |
| ***B21J 15/32*** | (2006.01) |
| ***B21J 15/20*** | (2006.01) |
| ***B25B 27/00*** | (2006.01) |
| ***B21J 15/10*** | (2006.01) |

(52) U.S. Cl.
CPC ..... *B21J 15/32* (2013.01); *B21J 15/386* (2013.01); *B25B 27/0014* (2013.01)

(58) Field of Classification Search
USPC ..... 29/243.523
See application file for complete search history.

(56) References Cited

U.S. PATENT DOCUMENTS

| | | | | |
|---|---|---|---|---|
| 7,032,281 | B1 * | 4/2006 | Lin | B25B 27/0014 29/243.523 |
| 7,155,953 | B1 * | 1/2007 | Nikkel | B21J 15/046 29/243.526 |
| 8,161,622 | B2 * | 4/2012 | King | B21J 15/043 29/243.521 |
| 8,561,275 | B2 * | 10/2013 | Wille | B25B 27/0014 29/243.523 |
| 8,672,054 | B2 * | 3/2014 | Frenken | B25D 9/12 173/169 |
| 2011/0308055 | A1 * | 12/2011 | Wille | B25B 27/0014 29/243.523 |

* cited by examiner

RIVETING TOOL

BACKGROUND OF THE INVENTION

Field of the Invention

The invention relates to a riveting tool for setting blind rivet nuts and/or blind rivet screws, comprising a drive piston which is able to be hydraulically adjusted from an initial position toward an end position; and a pull rod which is releasably and operatively connected to the drive piston and which is able to be adjusted by the drive piston from a rivet receiving position into a setting position; and a coupling element fixing the pull rod and a drawing mandrel to one another in the longitudinal axial direction.

Description of Related Art

Blind rivet nuts and/or blind rivet screws are rivets which have a thread and which, for example, are used when a lower face, an inner face or a rear face of a component is not accessible or only accessible with difficulty. Blind rivet nuts or blind rivet screws also then provide the opportunity of applying threads to components if said components have a wall thickness which is too small in order to permit the cutting of threads.

Riveting tools of the type mentioned in the introduction are used in this case in order to fasten the blind rivet nuts or the blind rivet screws in a convenient manner to the respective component. In this case, the rivet to be set is arranged on the component by a defined deformation, by means of the pull rod which is adjustable between the rivet receiving position and the setting position and which is connected to the drawing mandrel, wherein the drawing mandrel has an internal or external thread which is adapted to the respective rivet to be set. The deformation of the rivet in this case is determined by the stroke of the pull rod applied by the drawing mandrel, from the initial position into the adjustable setting position. For setting the blind rivet nuts and/or the blind rivet screws, said blind rivet nuts and/or blind rivet screws are previously screwed onto the drawing mandrel and introduced into a previously produced opening of the component for receiving the rivet and subsequently set by the stroke of the drawing mandrel applied by the riveting tool, wherein the rivet in this case is deformed in a defined manner as it is supported on a setting head on the riveting tool.

In this case, the length of the setting movement which is determined by the adjustment path of the drawing mandrel connected to the pull rod is essential for the quality of the connection between the set rivet and the component, wherein the pull rod is adjusted by the drive piston. The adjustment path, i.e. the stroke path of the drawing mandrel starting from the rivet receiving position of the pull rod as far as the setting position thereof, determines the strength of the connection of the component and rivet. The adjustment path in this case is dependent, amongst other things, on the material thickness of the components and the rivet used. Generally, in conventional riveting tools the adjustment path is controlled in this case via the hydraulic pressure or respectively the setting force. The setting movement is terminated, for example, by an automated or manual switching-off of a pump unit, when a preset pressure or respectively force is reached.

Such a pressure-controlled or respectively force-controlled setting of rivets, however, has the drawback that it leads to setting processes which are of variable quality, in particular in the case of a manual interruption to the setting process by the operator when a preset pressure is reached. Proceeding therefrom, the object of the invention is to provide a riveting tool of the type mentioned in the introduction by which uniform setting processes of rivets may be carried out with a high degree of repeated accuracy.

BRIEF SUMMARY OF THE INVENTION

The invention achieves the object by a riveting tool having the features of claim 1. Advantageous further embodiments of the invention are disclosed in the dependent claims.

It is characteristic of the riveting tool according to the invention that said riveting tool for fixing the setting position has an adjusting unit with a stroke-limiting element which is axially adjustable relative to the coupling element in the longitudinal axial direction of the pull rod, wherein the stroke-limiting element is in engagement with the coupling element via a stop surface in the setting position. According to the invention it is accordingly provided that the riveting tool comprises an adjusting unit which mechanically limits the stroke exerted on the rivet to be set by the pull rod or respectively drawing mandrel by a stroke-limiting element which is able to be positioned in the longitudinal axial direction. The positioning in the axial direction which takes place in the longitudinal axial direction of the pull rod relative to the coupling element, i.e. in relation to said coupling element, permits the stroke to be fixed mechanically in a predetermined manner. The setting movement is fixed by a stop of the coupling element on the stop surface of the stroke-limiting element, wherein the stroke-limiting element is fixed to the riveting tool, relative to the pull rod and the drawing mandrel.

The embodiment of the riveting tool according to the invention thus permits a simple adjustment and fixing of the setting stroke to be exerted on the rivet to be set, without adapting the drive unit comprising the drive piston, so that the blind rivet nut or blind rivet screws may be set with a high degree of repeated accuracy. The use of the coupling element as an operative element which is able to be brought into engagement with the stop surface of the stroke-limiting element permits a separate stop part, which might be brought into an operative connection with the stroke-limiting element, to be dispensed with. The coupling element thus fulfils the function firstly of connecting the pull rod with a replaceable drawing mandrel in the axial direction. Secondly, it provides a contact surface for the stop surface of the stroke-limiting element. The riveting tool according to the invention, therefore, may be designed to be particularly simple and compact. Additionally, since an adaptation of the drive unit is not necessary, there is the possibility of modifying conventional pressure-controlled riveting tools by the connection to the adjusting unit, so that a stroke-controlled treatment of the blind rivet nuts and/or blind rivet screws is then possible by means of riveting tools thus modified.

According to a particularly advantageous further embodiment of the invention which is suitable, in particular, for modifying existing riveting tools, it is provided that the adjusting unit as a stroke-limiting element comprises a stop sleeve which is mounted fixedly in terms of rotation relative to the pull rod and which is adjustable in the longitudinal axial direction, and which is in engagement via an external thread with an internal thread of an adjusting ring rotatably mounted on the riveting tool. According to this embodiment of the invention, a stop sleeve which is displaceable along the pull rod forms the stroke-limiting element which is able to be brought into engagement with the coupling element. For positioning the stop sleeve relative to the coupling element, the stop sleeve in this case comprises an external thread which is in engagement with an internal thread of an adjusting ring. The adjusting ring in turn is rotatably mounted on the riveting tool, but in this case it is fixed in the longitudinal axial direction to the riveting tool, so that a rotation of the adjusting ring effects a displacement of the stop sleeve—depending on the direction of rotation—in the direction of the coupling element or away from said coupling element.

This embodiment of the invention permits a simple and reliable adjustment of the position of the stop sleeve and thus a fixing of the stroke which may be exerted by the riveting tool. The arrangement of the stop sleeve which is fixed in terms of rotation may in this case be implemented in any manner in principle. For example, a tongue and groove connection is conceivable between the pull rod and the stop sleeve. According to a particularly advantageous embodiment of the invention, however, it is provided that the stop sleeve is displaceably mounted on one, preferably two, particularly preferably four, cylinder pins extending parallel to the pull rod in the longitudinal axial direction.

Accordingly, inside the adjusting unit at least one, preferably two, particularly preferably four, cylinder pins extend parallel to the longitudinal axial direction of the pull rod by being correspondingly received on the stop sleeve so that the stop sleeve is mounted fixedly in terms of rotation relative to the pull rod. The use of cylinder pins in this case represents a particularly simple option for a mounting which is fixed in terms of rotation and which may take place without adapting the pull rod. The mounting of the cylinder pins in this case may take place at a suitable point inside the adjusting unit. This embodiment of the invention also permits a simple adaptation of existing, purely pressure-controlled riveting tools so that after modification said riveting tools provide the option of the stroke-controlled setting of rivets.

In order to simplify a modification of existing riveting tools, according to a further embodiment of the invention it is also provided that the adjusting unit is releasably connected, in particular is screwed, to a base body of the riveting tool. This embodiment of the connection which improves the modular construction of the riveting tool, in addition to the simple modification of existing riveting tools, provides the possibility of adapting the riveting tool in a simple manner to the conditions of use. The adjusting unit which is able to be selected from a group of different adjusting units is to this end preferably connected, in particular screwed, to a base body of a suitable drive unit and thus forms a riveting tool which is optimally adapted to the purpose of use. Moreover, by this embodiment of the invention, pressure-controlled riveting tools may be modified in a simple manner, wherein to this end the adjusting unit only has to be adapted to the drive units of the pressure-controlled riveting tools. For adapting the drive unit to the adjusting unit in this case, for example, an adapter ring may also be provided, said adapter ring being designed, at the one end, with a thread adapted to a base housing of the drive unit and, at the other end, with a thread adapted to the adjusting unit.

The adjusting unit according to the invention permits a freely selectable positioning of the stroke-limiting element within the adjustment range of the stroke-limiting element. According to a particularly advantageous embodiment of the invention, it is provided that the adjusting ring comprises latching marks which are able to be brought into engagement with latching bodies on the drive unit, in particular with latching bodies on an adapter ring which is able to be fixed to the drive unit.

According to this embodiment of the invention, according to the arrangement of latching marks and latching bodies, the adjusting ring is engaged in predetermined positions and thus additionally prevents a displacement of the stroke-limiting element during operation of the riveting tool. Additionally, the latching marks and latching bodies may be arranged such that, after a defined longitudinal adjustment of the stroke-limiting element, said latching marks and latching bodies repeatedly come into engagement so that haptic feedback about the adjustment of the stroke-limiting element is provided to the user. In this case, for example, spring-loaded latching balls may be used as latching bodies, which are able to be brought into engagement with domed recesses on the adjusting ring. Also conceivable is an arrangement of the latching marks on the drive unit and the latching bodies on the adjusting ring, wherein the function is ensured in an identical manner.

According to a further embodiment of the invention, it is further provided that the adjusting ring comprises an opening in order to be able to view the stroke-limiting element, said opening being particularly preferably provided on one edge with a scale for positioning the stroke-limiting element. According to this embodiment of the invention, by means of an opening the adjusting ring permits a view of the stroke-limiting element so that the position thereof is visible from outside. A scale which is additionally arranged on the edge of the opening, which corresponds with markings on the visible stroke-limiting element, also permits a very accurate adjustment of the setting stroke so that the riveting tool may be easily adapted to the operating conditions.

The embodiment of the adjusting unit is freely selectable, in principle, wherein it has to be ensured that in the mounted state on the drive unit a displacement is blocked in the longitudinal axial direction. According to a further embodiment of the invention, the adjusting unit comprises a base unit and a head piece, wherein the head piece is coaxially arranged relative to the coupling element and is releasably connected to the base unit via a quick-release connector. The base unit of the adjusting unit in this case represents the unit which is connected to the drive unit of the riveting tool and advantageously the adjusting ring is also formed thereon. The head piece is coaxially arranged relative to the coupling element and, for example, comprises the setting head adapted to the blind rivet nuts and/or blind rivet screws to be set. The advantage according to this embodiment of this invention, according to which the head piece is releasably connected to the base unit via a quick-release connector, is in a simple and rapid access to the coupling element so that, if required, the entire adjusting unit does not have to be dismantled in order to adapt the riveting tool to the use of different blind rivet nuts and/or blind rivet screws. A replacement of the drawing mandrel may take place in a simple manner by removing the head piece from the base unit, wherein to this end the quick-release connector represents a particularly simple and convenient embodiment.

According to a particularly advantageous embodiment of the invention, the quick-release connector may, for example, comprise a sliding sleeve which is pretensioned toward a latching position and which in the latching position pushes a latching element into a latching mark on the base unit. This embodiment of the invention represents a particularly simple and secure arrangement of the head piece on the base unit, wherein via the sliding sleeve the latching element is able to be adjusted between a latching position and a released position. The pretensioning of the sliding sleeve toward the latching position ensures in this case that the latching element in the unloaded state of the sliding sleeve, i.e. in the mounted state, is permanently in engagement with a latching mark.

According to a further embodiment of the invention, the head piece comprises the setting head which is releasably connected thereto and which is coaxially arranged relative to the drawing mandrel. The arrangement of the setting head on the head piece may be implemented in a particularly simple and convenient manner, wherein a simple adaptation of the head piece, the riveting tool being supported thereon during the drawing process, is possible by means of the releasable arrangement. Thus there is the possibility of a simple modification of the riveting tool in order to adapt to different blind rivet nuts or blind rivet screws.

The embodiment of the coupling element may, in principle, take place in any manner. According to a particularly advantageous embodiment of the invention, it is further provided that the coupling element comprises two half-shells coaxially arranged relative to the drawing mandrel and the pull rod, the front face of said half-shells which faces the stop surface of the stroke-limiting element being configured as a contact surface and, in particular, comprising a lubricant coating. The embodiment of the coupling element by two half-shells represents a particularly simple and convenient option for connecting the drawing mandrel and the pull rod, wherein by means of inwardly protruding projections or peripheral rings, which engage in corresponding recesses on the drawing mandrel and the pull rod, a particularly simple fixing of the drawing mandrel and pull rod may take place in the axial direction. The embodiment of the front surface as a contact surface, according to which this front surface is configured, for example such that jamming with the stop surface is prevented, permits separate functional elements to be dispensed with. In particular, the arrangement of a lubricant coating on the front surface ensures an operation of the riveting tool according to the invention without interruption.

According to a further embodiment of the invention, it is further provided that the drive piston is pretensioned, in particular spring-pretensioned, toward the initial position. This embodiment of the invention ensures a reliable return of the drive piston into the initial position after terminating the stroke process.

BRIEF DESCRIPTION OF THE SEVERAL VIEWS OF THE DRAWING(S)

An exemplary embodiment of the invention is described hereinafter with reference to the drawings, in which.

Figure 1:
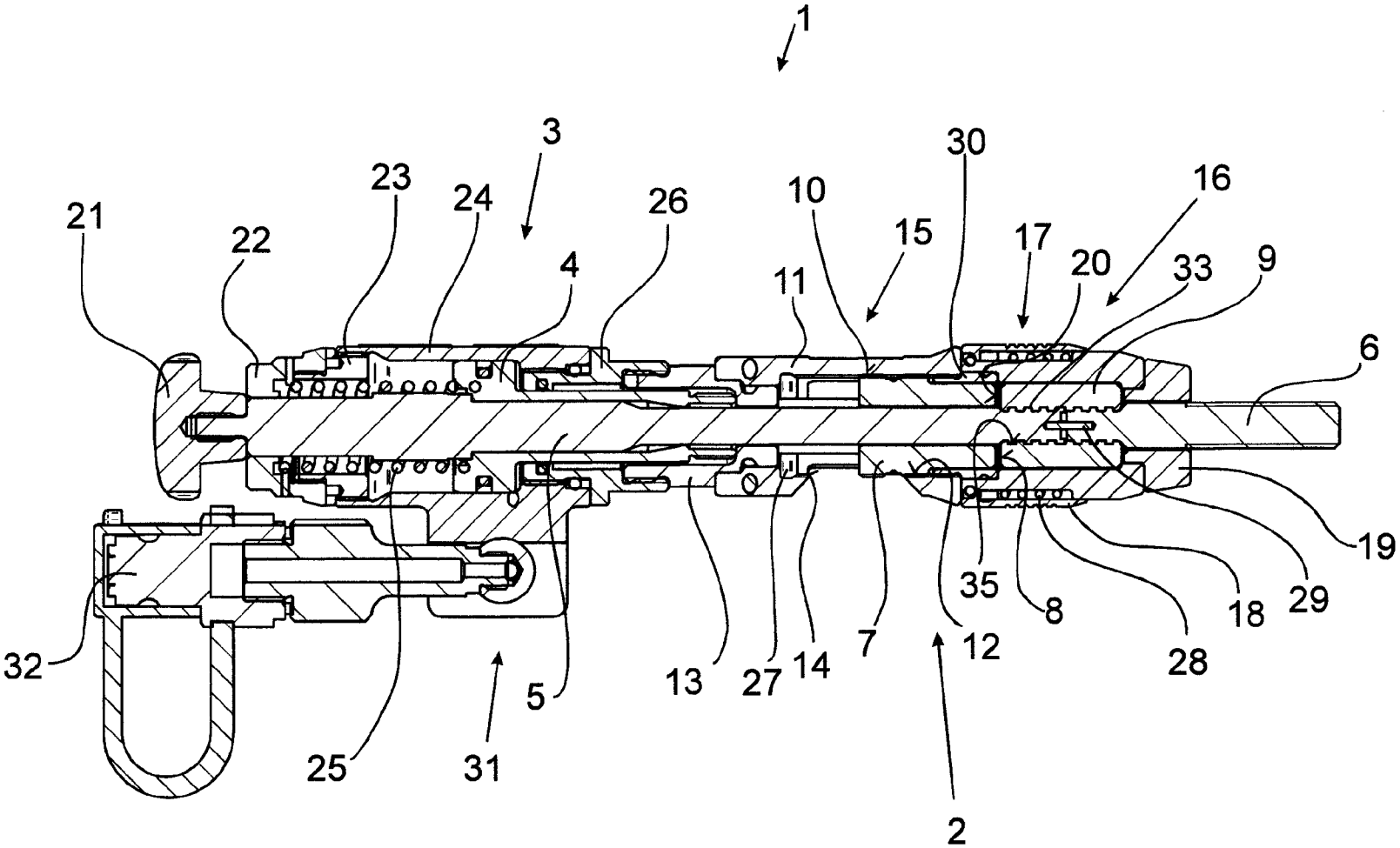
FIG. 1 shows a view of a section of a riveting tool.
Figure 3A:
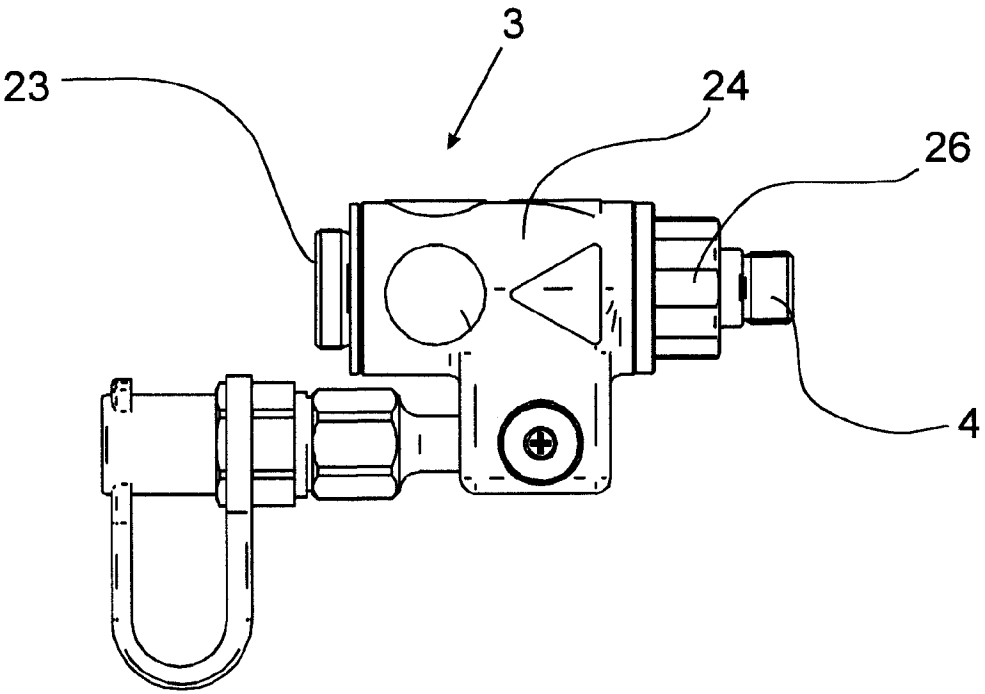
Figure 3B:
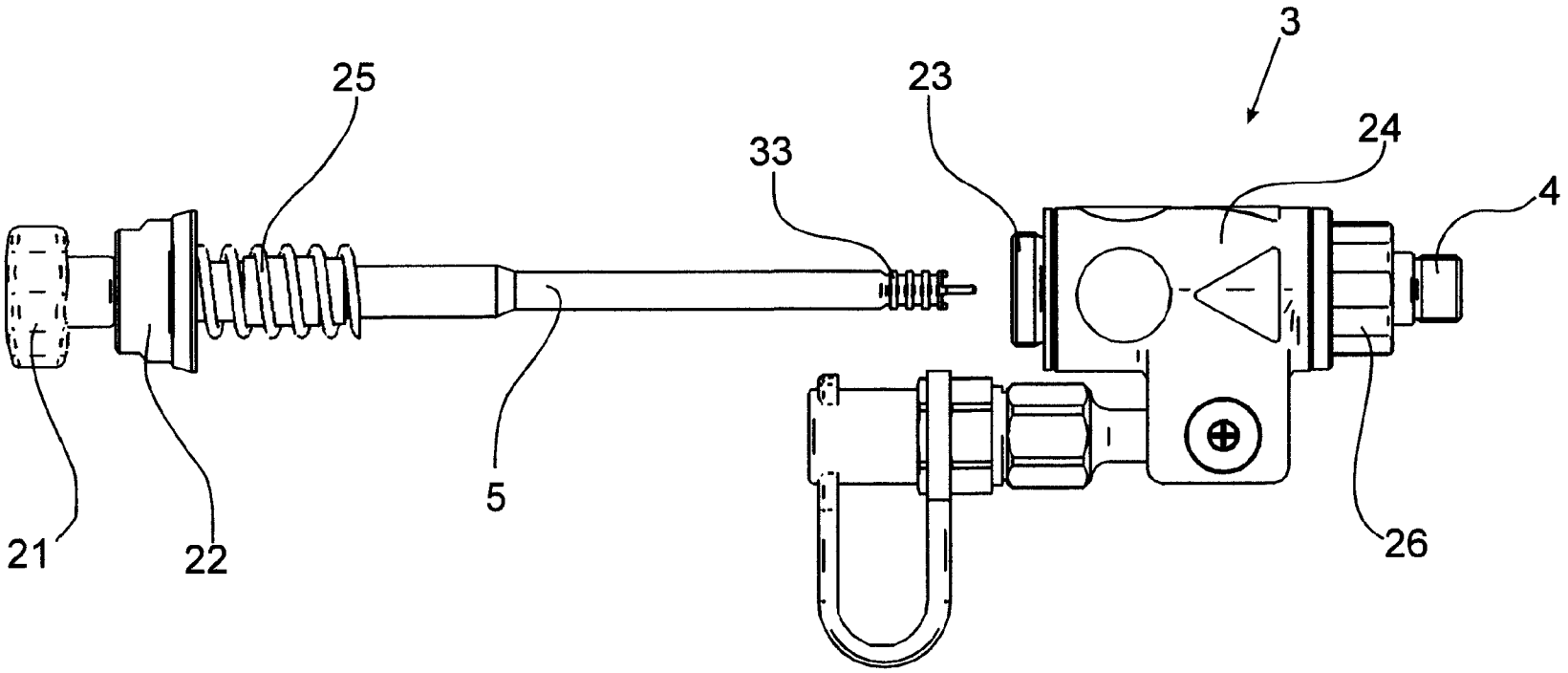
Figure 3C:
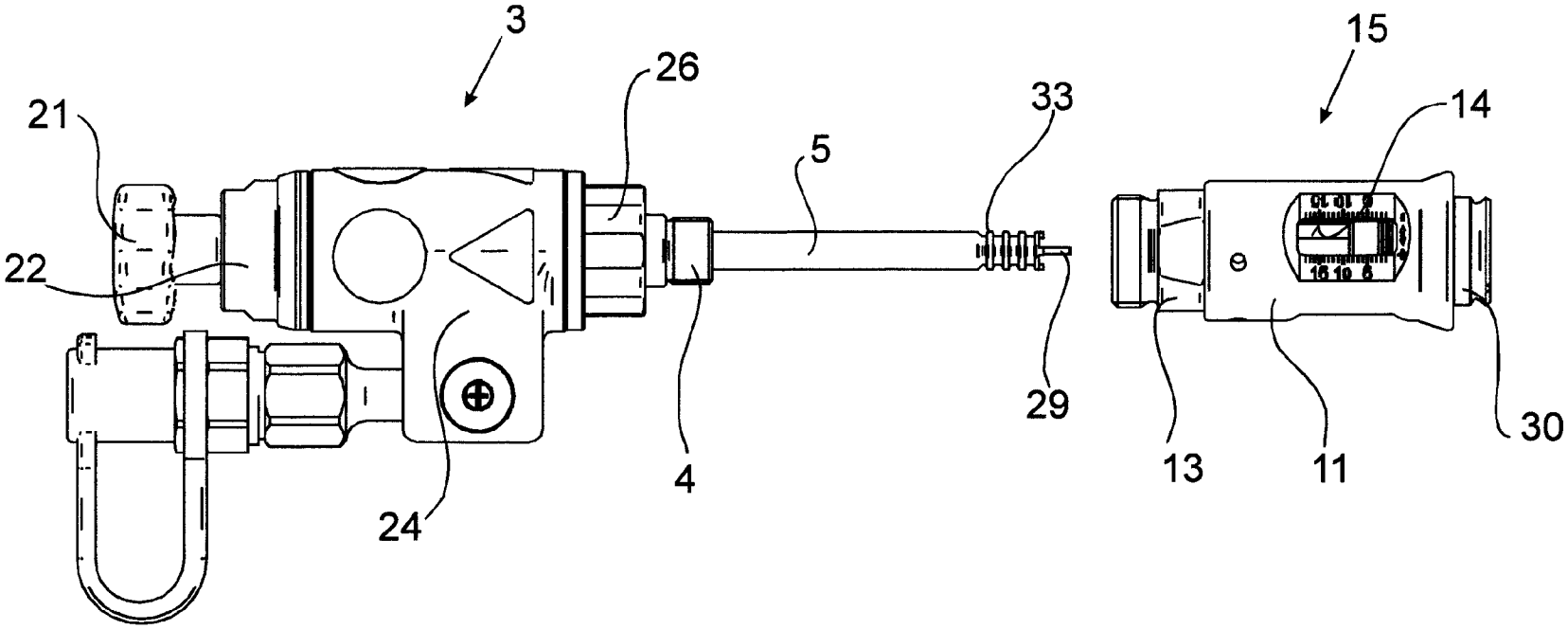
Figure 3D:
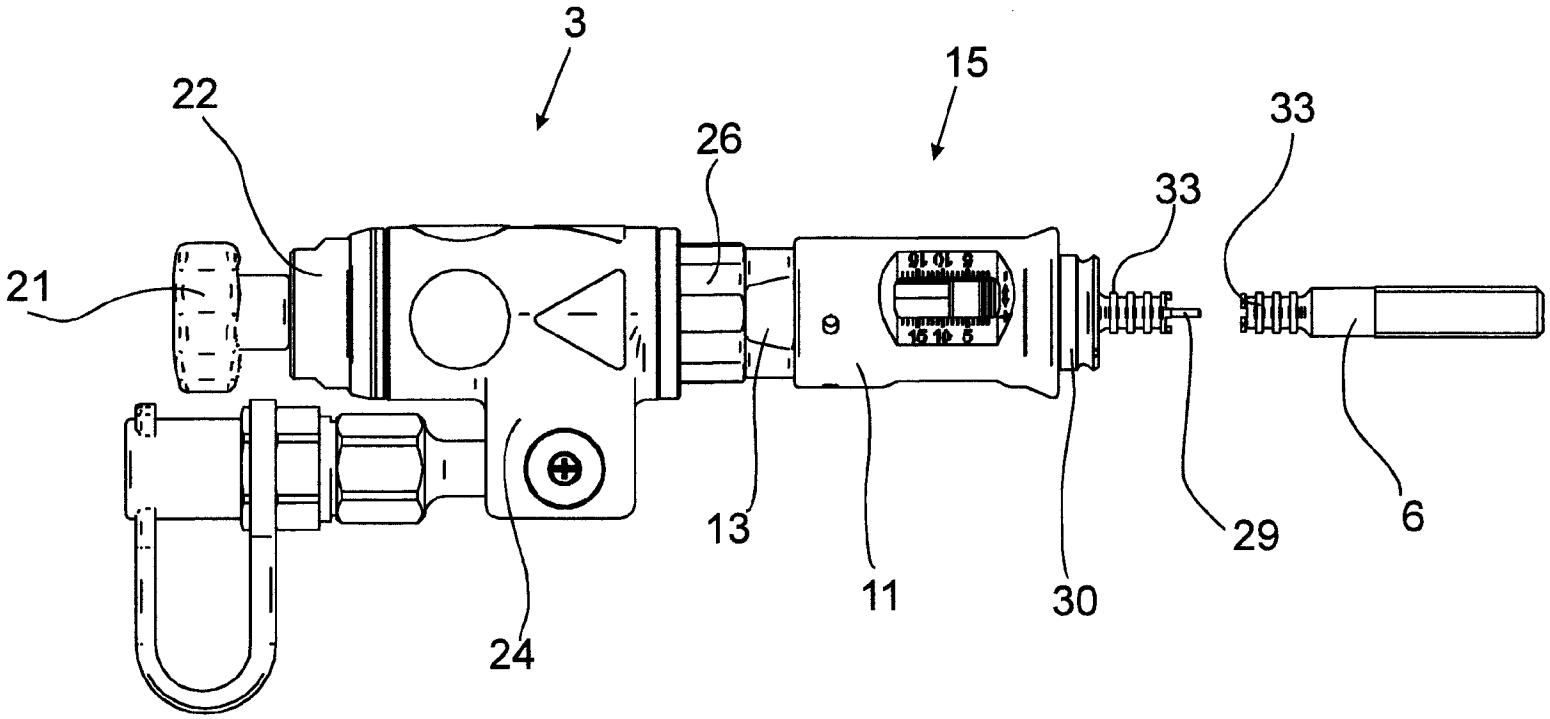
Figure 3E:
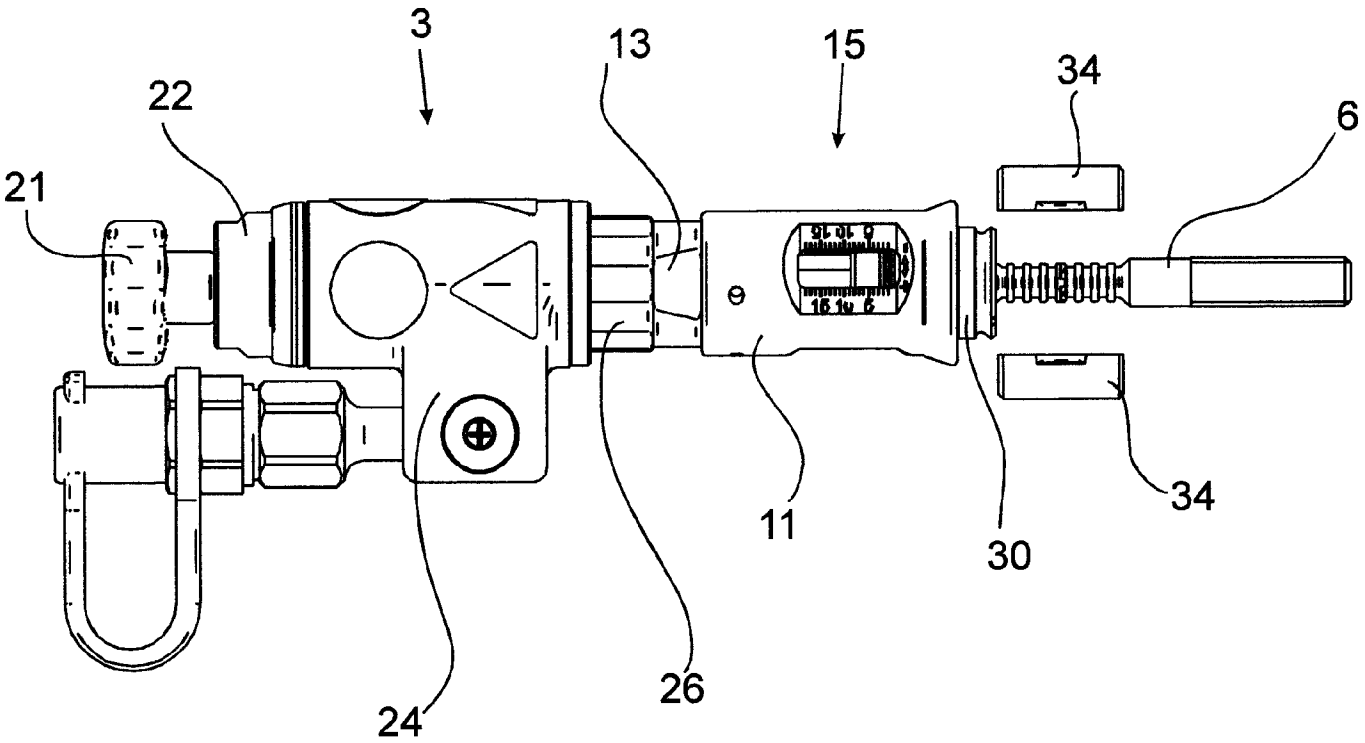
Figure 3F:
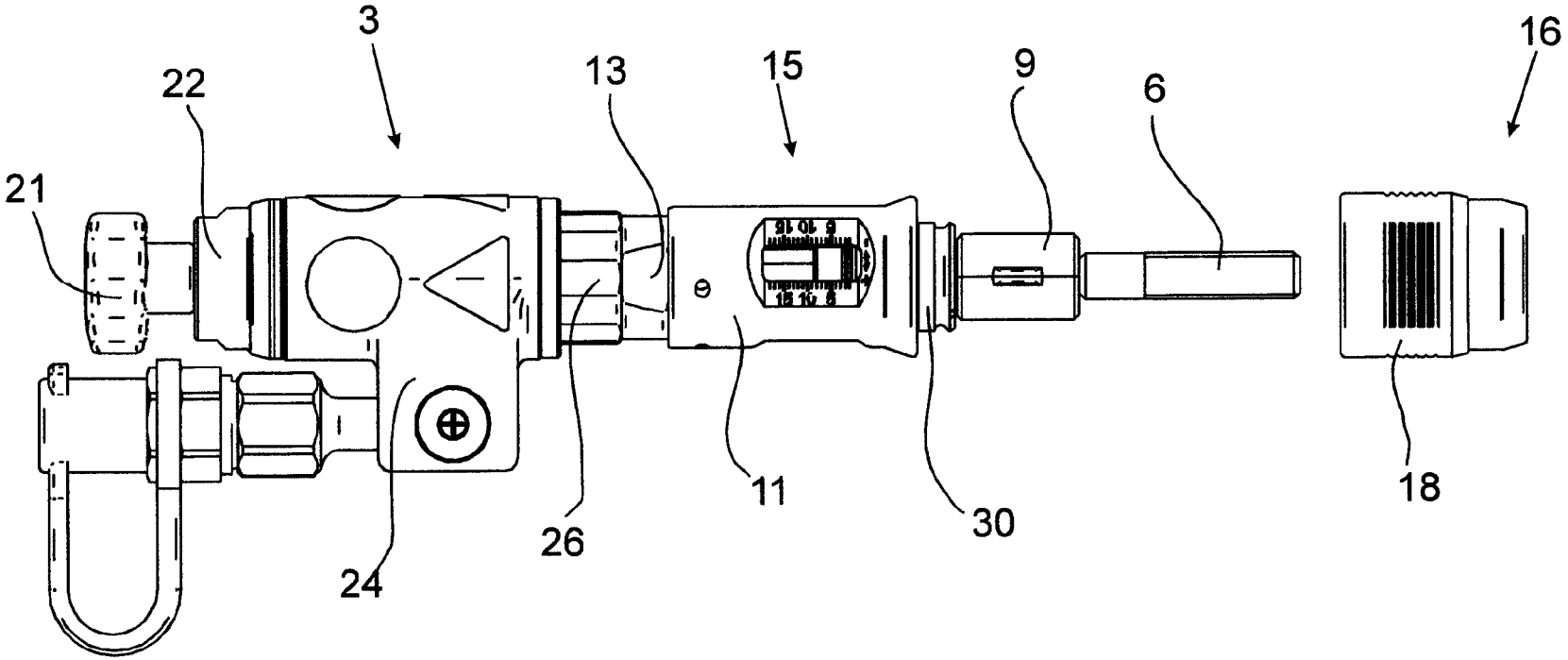
Figure 3G:
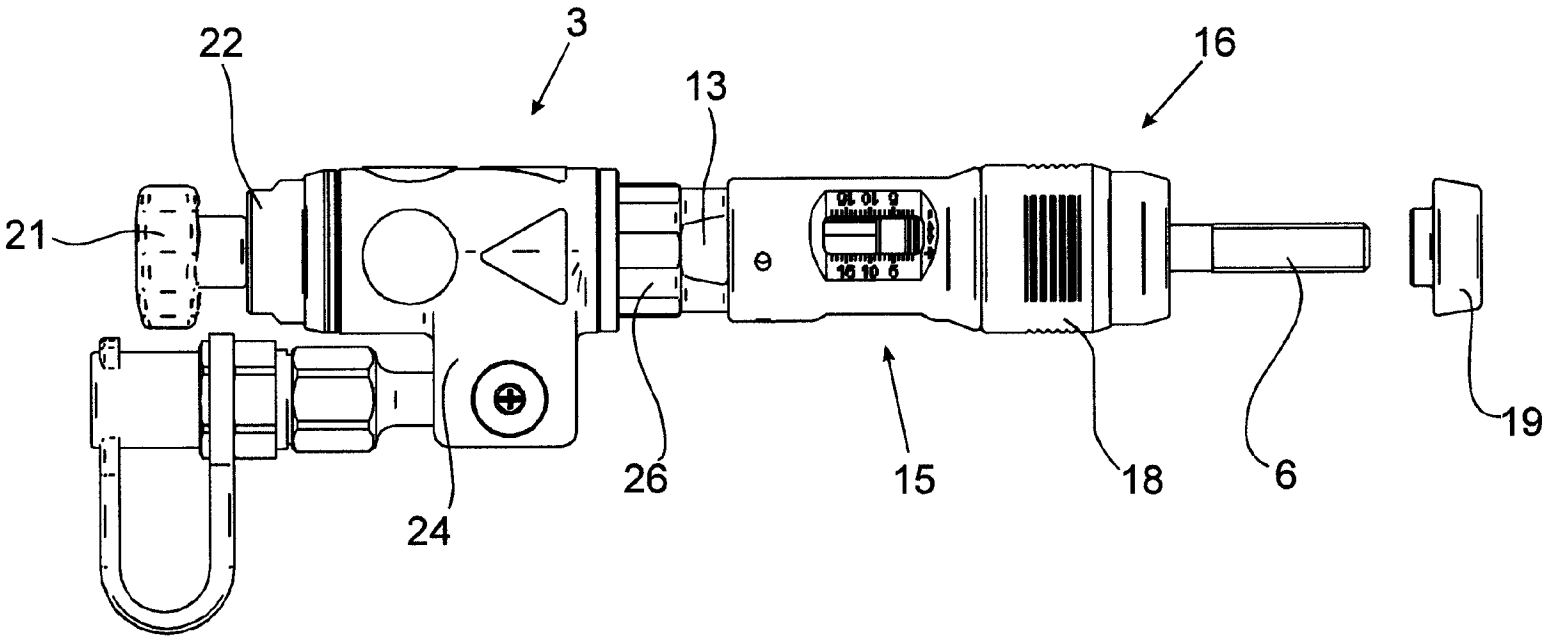
Figure 3H:
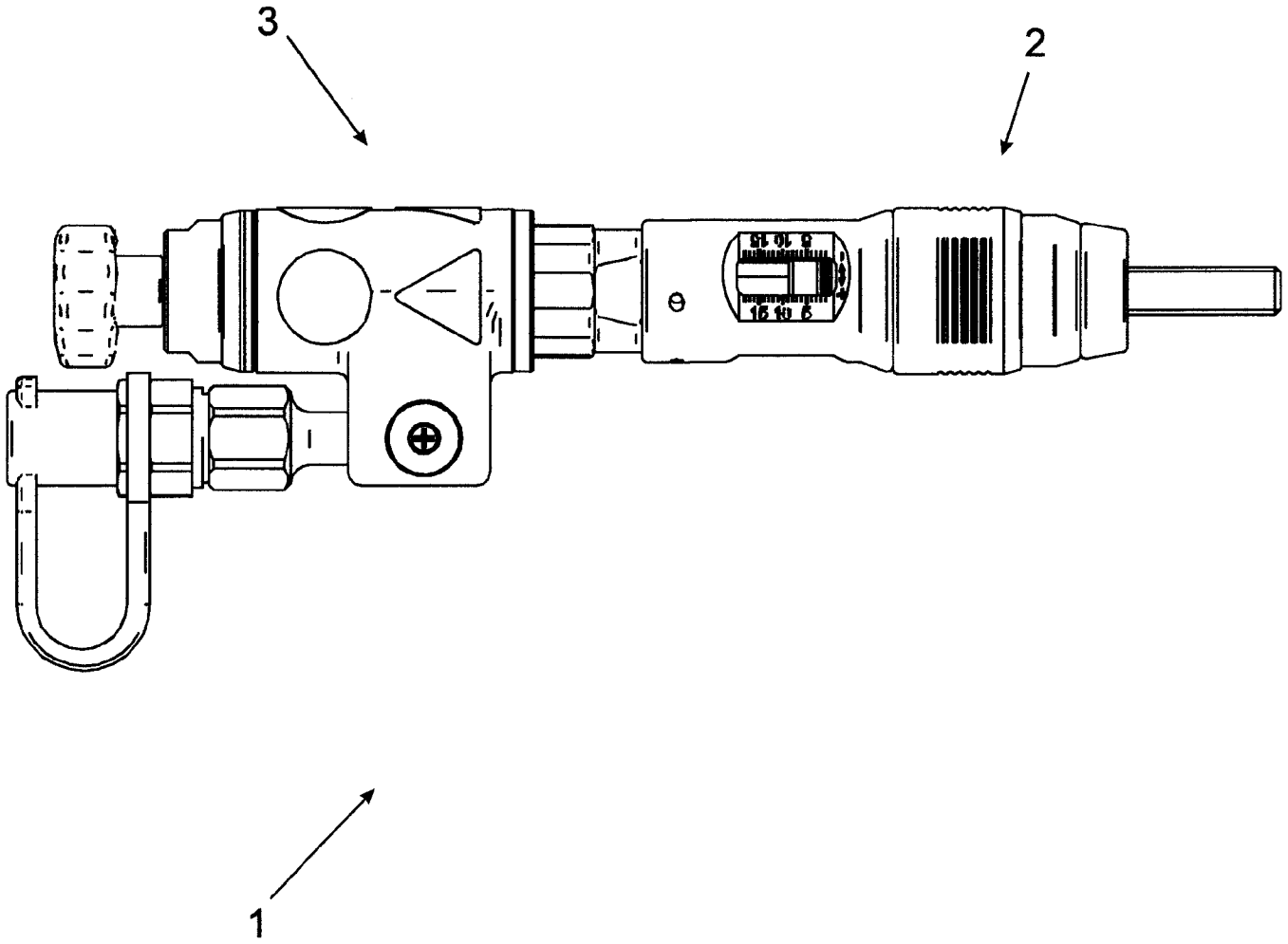

FIG. 3*a* shows a side view of a drive unit of the riveting tool of FIG. 1;

FIG. 3*b* shows a side view of the drive unit of FIG. 3*a* with a pull rod to be inserted in the drive unit;

FIG. 3*c* shows a side view of the drive unit of FIG. 1 with the inserted pull rod and a base unit of an adjusting unit to be arranged;

FIG. 3*d* shows a side view of the drive unit of FIG. 1 with the inserted pull rod and base unit arranged and drawing mandrel to be arranged;

FIG. 3*e* shows a side view of the drive unit of FIG. 1 with the inserted pull rod, the base unit arranged and the drawing mandrel arranged and half-shells of a coupling element to be arranged;

FIG. 3*f* shows a side view of the drive unit of FIG. 1 with the inserted pull rod, the base unit arranged and the drawing mandrel and coupling element arranged and the head piece to be arranged;

FIG. 3*g* shows a side view of the drive unit of FIG. 3*a* with the inserted pull rod, the base arranged and the drawing mandrel, coupling element and head piece arranged, and the setting head to be arranged and FIG. 3*h* shows a side view of the riveting tool of FIG. 1 in the mounted state.

DETAILED DESCRIPTION OF THE INVENTION

Figure 2:
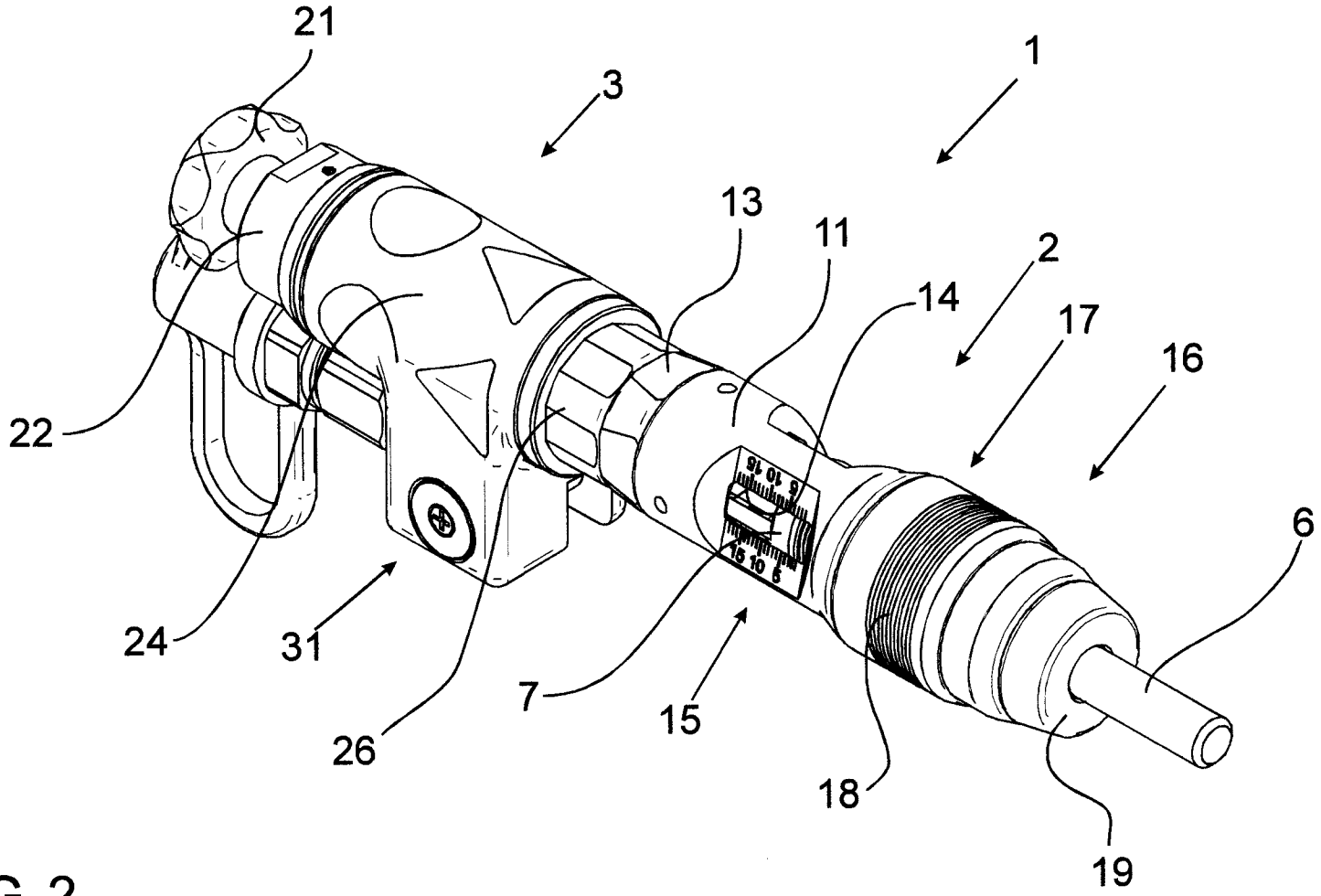
FIG. 2 shows a perspective view of the riveting tool of FIG. 1.

A riveting tool 1 shown in FIG. 1 in a sectional view and in FIG. 2 in a perspective view substantially has two sub-assemblies. In this case, firstly this is a drive unit 3 comprising a drive piston 4 and secondly this is an adjusting unit 2 connected to the drive unit 3, a setting stroke applied by the drive piston 4 to a pull rod 5 being able to be fixed in its stroke length by said adjusting unit.

The drive unit 3 of the riveting tool 1 has a base body 24, the drive piston 4 being able to be displaced therein in its longitudinal axial direction. An adjustment of the drive piston 4 in this case takes place by means of a hydraulic pressure, hydraulic fluid being conducted through a pipe connector 32 via a joint 31 into the base body 24 for the production of said hydraulic pressure, so that the drive piston 4 is displaced counter to a pretensioning applied by a helical compression spring 25 from its initial position toward an end position. In this case, due to its support at one end on the drive piston 4 and at the other end on a housing cover 22 which is connected to the base body 24 via a threaded bushing 23, the helical compression spring 25 causes the drive piston 4 in the pressureless state to be held in its initial position.

For transmitting the axial movement of the drive piston 4 to a drawing mandrel 6 connected to the pull rod 5, the drive piston 4 has a shoulder, the pull rod 5 bearing thereagainst with a corresponding shoulder. Via the shoulders, movements of the drive piston 4 which are oriented in the direction of the end position are transmitted directly to the pull rod 5.

The base body 24 forming a base housing of the drive unit 3 has on its end opposing the housing cover 22 a housing bushing 26 which is connected to an adapter ring 13 of the adjusting unit 2 via an internal thread. The adjusting unit 2 serves for adjusting the setting stroke to be applied by the riveting tool 1, the adjusting unit 2 having to this end a stroke-limiting element configured as a stop sleeve 7. Said stroke-limiting element forms an adjustable mechanical stop for a coupling element 9, the pull rod 5 being connected thereby to the drawing mandrel 6.

For positioning the stop sleeve 7 and thus for adjusting the setting stroke, the adjusting unit 2 has an adjusting ring 11 which is fixed in the axial direction relative to the base body 24 of the drive unit 3 but is rotatable relative to the adapter ring 13. The stop sleeve 7 is mounted fixedly in terms of rotation via two cylinder pins, not shown here and fixed parallel to the longitudinal axis of the pull rod 5 inside the adjusting ring 11, wherein the cylinder pins engage in corresponding openings on the stop sleeve 7. A rotation of the adjusting ring 11 thus effects an axial displacement of the stop sleeve 7 inside the adjusting ring 11 in the longitudinal axial direction of the pull rod 5. A transmission of the rotational movement of the adjusting ring 11 to the stop sleeve 7 arranged coaxially to the pull rod 5 in this case takes place via an internal thread 12 of the adjusting ring onto an external thread 10 on the stop sleeve 7. Said stop sleeve is thus freely positionable inside the adjusting ring 11 on the pull rod 5 and with its stop surface 8 provides a path-limiting device for the coupling element 9. In the maximum setting position, the coupling element 9 bears with its front face 20 against the stop surface 8 of the stop sleeve 7. The maximum adjustable stroke in this case is determined by the position in which the stop sleeve 7 bears against a stop ring 27 inside the adjusting ring 11.

In order to permit the drawing mandrel 6 to be changed in a simple manner, the adjusting unit 2 also has a head piece 16 which may be removed via a quick-release connector 17 from the adjusting unit 2. In the removed position, the coupling element 9 is freely accessible so that the drawing mandrel 6 may be replaced in a simple manner. The quick-release connector 17 with a sliding sleeve 18 serves for rapid removal of the head piece 16, said sliding sleeve being pretensioned by a helical compression spring 28 into the latching position shown in FIG. 1, in which latching elements, not shown here, engage in latching marks, also not shown here, on a connecting bushing 30, wherein the connecting bushing 30 is inserted into the end of the adjusting ring 11 opposing the drive unit 3. The end of the head piece 16 opposing the drive unit 2 is formed by a replaceable setting head 19, a rivet, not shown here, being supported thereon during the setting process, so that the deformation of the rivet required for the setting may take place when the drawing mandrel 6 is displaced during the setting process from the position shown in FIG. 1 in the direction of the drive unit 3.

For the operation of the riveting tool 1 it is necessary for the pull rod 5 and the drawing mandrel 6 to be fixed to one another both in the axial direction and in the peripheral direction. For fixing in the axial direction the pull rod 5 and the drawing mandrel 6 comprise projections 33 which are configured so as to correspond to recesses 35 arranged inside the coupling element 9, whereby in the mounted state a positive connection is achieved in the longitudinal axial direction. For the connection which is fixed in terms of rotation, the front faces bearing against one another of the pull rod 5 and the drawing mandrel 6 have a corresponding toothing, wherein a centering pin 29 ensures the relative position of the pull rod 5 and the drawing mandrel 6. Following the setting process, due to the connection which is fixed in terms of rotation of the pull rod 5 and the drawing mandrel 6, the drawing mandrel 6 may be screwed from the blind rivet nut and/or blind rivet screw via a handle 21 arranged at the end opposing the drawing mandrel 6.

An assembly of the riveting tool 1 is shown in a stepwise manner in FIGS. 3*a* to 3*h*. The pull rod 5 is initially inserted into the drive unit 3, shown in FIG. 3*a*, and fixed to the base body 24 via a housing cover 22. In the mounted state of the pull rod 5 (see FIG. 3*c*) said pull rod protrudes from the base body 24 on the side opposing the handle 21. The base unit 15 of the adjusting unit 2 is then pushed onto this free end of the pull rod 5, and screwed to the housing bushing 26, wherein to this end the base unit 15 comprises an adapter ring 13 which is adapted to a housing bushing 26 on the drive unit. After the connection of the base unit 15, as shown in FIG. 3*d*, the drawing mandrel 6 is positioned fixedly in terms of rotation by means of the centring pin 29 at the free end of the push rod 5. For the positive connection in the longitudinal axial direction, the coupling element 9 which consists of two coupling half-shells 34, is positioned onto the portions of the pull rod 5 and drawing mandrel 6 provided with projections 33 (see FIG. 3*e*). The positioning of the sliding sleeve 18 of the head piece 16 (see FIG. 3*e*) takes place after the arrangement of the coupling element 9. Subsequently thereto, the setting head 19 adapted to the rivet to be set is then positioned on the head piece 16, so that the riveting tool 1 is subsequently in the fully mounted position shown in FIG. 3*h*.

LIST OF REFERENCE NUMERALS

1 Riveting tool
2 Adjusting unit
3 Drive unit
4 Drive piston
5 Pull rod
6 Drawing mandrel
7 Stroke-limiting element (stop sleeve)
8 Stop surface
9 Coupling element
10 External thread (stop sleeve)
11 Adjusting ring
12 Internal thread (adjusting ring)
13 Adapter ring
14 Opening (adjusting ring)
15 Base unit (adjusting unit)
16 Head piece
17 Quick-release connector
18 Sliding sleeve
19 Setting head
20 Front face
21 Handle
22 Housing cover
23 Threaded bushing
24 Base body
25 Helical compression spring
26 Housing bushing
27 Stop ring
28 Helical compression spring
29 Centering pin
30 Connecting bushing
31 Joint
32 Connector pipe
33 Projections
34 Half-shells
35 Recess It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A riveting tool for setting blind rivet nuts and/or blind rivet screws, comprising a hydraulic drive piston adjustable from an initial position toward an end position in a longitudinal axial direction, a pull rod which is releasably and operatively connected to the hydraulic drive piston and which is adjustable from a rivet receiving position into a setting position by movement of the hydraulic drive piston from the initial position toward the end position, a coupling element fixing the pull rod and a drawing mandrel to one another in the longitudinal axial direction, and an adjusting unit for fixing the setting position, wherein the adjusting unit comprises a stroke-limiting element which is axially adjustable relative to the coupling element in the longitudinal axial direction of the pull rod, wherein when the hydraulic drive piston is in the end position, said stroke-limiting element is in engagement with the coupling element via a stop surface of the coupling element.

2. The riveting tool according to claim 1, wherein the stroke-limiting element is configured as a stop sleeve having an external thread, said stop sleeve mounted fixedly in terms of rotation relative to the pull rod and adjustable in the longitudinal axial direction, said external thread engaged with an internal thread of an adjusting ring that is rotatably mounted on the riveting tool, such that rotation of the adjusting ring effects displacement of the stop sleeve.

3. The riveting tool according to claim 1, wherein the adjusting unit is releasably connected to a drive unit of the riveting tool.

4. The riveting tool according to claim 3, wherein the adjusting ring has latching marks for engaging one or more latching bodies on the drive unit.

5. The riveting tool according to claim 2, wherein the adjusting ring has an opening for viewing the stroke limiting element such that the position of the stroke limiting element is visible from the outside of the riveting tool.

6. The riveting tool according to claim 1, wherein the stroke-limiting element is displaceably mounted on at least one cylinder pin extending parallel to the pull rod in the longitudinal axial direction.

7. The riveting tool according to claim 1, wherein the adjusting unit has a base unit and a head piece, wherein the head piece is coaxially arranged relative to the coupling element and is releasably connected to the base unit via a quick-release connector.

8. The riveting tool according to claim 7, wherein the quick-release connector has a sliding sleeve which is pretensioned toward a latching position and which in the latching position engages with a latching element in a latching mark on the base unit.

9. The riveting tool according to claim 7, wherein the head piece comprises a setting head which is releasably connected to the head piece, wherein the setting head is coaxial with the drawing mandrel.

10. The riveting tool according to claim 1, wherein the coupling element has two half-shells coaxially arranged relative to the drawing mandrel and the pull rod, wherein a front face of said two half-shells faces the stop surface and is configured as a contact surface.

11. The riveting tool according to claim 1, wherein the hydraulic drive piston is pretensioned toward the initial position.

12. The riveting tool according to claim 3, wherein the adjusting unit is screwed to the drive unit of the riveting tool.

13. The riveting tool according to claim 4, wherein the latching bodies are on an adapter ring which is able to be fixed to the drive unit.

14. The riveting tool according to claim 5, wherein an edge of the adjusting ring adjacent to the opening comprises a scale configured for positioning the stroke-limiting element.

15. The riveting tool according to claim 6, wherein the at least one cylinder pin comprises two cylinder pins.

16. The riveting tool according to claim 10, wherein the front face of said two half-shells has a lubricant coating.

17. The riveting tool according to claim 11, wherein the drive piston is spring pretensioned toward the initial position.

18. A riveting tool for setting blind rivet nuts and/or blind rivet screws, comprising a hydraulic drive piston adjustable from an initial position toward an end position in a longitudinal axial direction, a pull rod which is releasably and operatively connected to the hydraulic drive piston and which is adjustable from a rivet receiving position into a setting position by movement of the hydraulic drive piston from the initial position toward the end position, a coupling element fixing the pull rod and a drawing mandrel to one another in the longitudinal axial direction, an adjusting unit for fixing the setting position, wherein the adjusting unit comprises a stroke-limiting element which is axially adjustable relative to the coupling element in the longitudinal axial direction of the pull rod, wherein when the hydraulic drive piston is in the end position, said stroke-limiting element is in engagement with the coupling element via a stop surface of the coupling element, and wherein the stroke-limiting element is configured as a stop sleeve having an external thread, said stop sleeve mounted fixedly in terms of rotation relative to the pull rod and adjustable in the longitudinal axial direction, said external thread engaged with an internal thread of an adjusting ring that is rotatably mounted on the riveting tool, such that rotation of the adjusting ring effects displacement of the stop sleeve.

19. A riveting tool for setting blind rivet nuts and/or blind rivet screws, comprising a hydraulic drive piston adjustable from an initial position toward an end position in a longitudinal axial direction, a pull rod which is releasably and operatively connected to the hydraulic drive piston and which is adjustable from a rivet receiving position into a setting position by movement of the hydraulic drive piston from the initial position toward the end position, a coupling element fixing the pull rod and a drawing mandrel to one another in the longitudinal axial direction, an adjusting unit for fixing the setting position, wherein the adjusting unit comprises a stroke-limiting element which is axially adjustable relative to the coupling element in the longitudinal axial direction of the pull rod, wherein when the hydraulic drive piston is in the end position, said stroke-limiting element is in engagement with the coupling element via a stop surface of the coupling element, and wherein the stroke-limiting element is a stop sleeve having an external thread, said stop sleeve mounted fixedly in terms of rotation relative to the pull rod and adjustable in the longitudinal axial direction, said external thread engaged with an internal thread of an adjusting ring that is rotatably mounted on the riveting tool, such that rotation of the adjusting ring effects displacement of the stop sleeve, wherein the adjusting unit is releasably connected to a base housing of the drive unit by an adapter ring, said adapter ring having a thread at an end that is adapted to the base housing of the drive unit, and said adapter ring having a thread at another end that is adapted to the adjusting unit.

* * * * *